US008006449B2

(12) United States Patent
Warnecke

(10) Patent No.: US 8,006,449 B2
(45) Date of Patent: Aug. 30, 2011

(54) DRAIN SUPPORT PLATE/UNDER-DECK CLAMP

(75) Inventor: Lawrence Warnecke, Ladner (CA)

(73) Assignee: Zurn Industries, LLC, Erie, PA (US)

( * ) Notice: Subject to any disclaimer, the term of this patent is extended or adjusted under 35 U.S.C. 154(b) by 64 days.

(21) Appl. No.: 12/054,559

(22) Filed: Mar. 25, 2008

(65) Prior Publication Data

US 2008/0222800 A1 Sep. 18, 2008

Related U.S. Application Data

(60) Continuation of application No. 11/122,448, filed on May 5, 2005, now Pat. No. 7,784,242, which is a division of application No. 10/342,148, filed on Jan. 14, 2003, now Pat. No. 6,953,208.

(60) Provisional application No. 60/348,734, filed on Jan. 15, 2002.

(51) Int. Cl.

| | |
|---|---|
| ***E04B 1/70*** | (2006.01) |
| ***E04D 1/36*** | (2006.01) |
| ***E04B 5/00*** | (2006.01) |
| ***E04F 17/00*** | (2006.01) |

(52) U.S. Cl. ..... 52/302.6; 52/58; 52/302.1; 52/408

(58) Field of Classification Search ..... 52/302.1, 52/302.6, 198, 58, 408; 210/163; 4/288, 4/679, 680, 695; 285/42; 248/49, 56, 58; 138/41

See application file for complete search history.

(56) References Cited

U.S. PATENT DOCUMENTS

| | | | | |
|---|---|---|---|---|
| 1,123,705 | A | 1/1915 | Dehn | |
| 1,532,897 | A | 4/1925 | Hirshstein | |
| 1,690,630 | A | 11/1928 | Fleming | |
| 1,963,300 | A | 6/1934 | Fleming | |
| 2,278,566 | A * | 4/1942 | Schaible | 285/148.11 |
| 2,888,138 | A * | 5/1959 | Baker et al. | 210/166 |
| 3,813,708 | A * | 6/1974 | Hamburg | 4/286 |
| 3,881,201 | A * | 5/1975 | Richards | 4/286 |
| 4,487,690 | A * | 12/1984 | Logsdon | 210/163 |
| 4,505,814 | A | 3/1985 | Marshall | |
| 4,694,513 | A * | 9/1987 | Kiziah | 4/288 |
| 4,964,180 | A * | 10/1990 | Harbeke | 4/288 |
| 5,615,526 | A * | 4/1997 | Palmer et al. | 52/302.1 |
| 5,618,416 | A | 4/1997 | Haefner | |
| 5,940,898 | A * | 8/1999 | Rowe | 4/286 |
| 5,966,884 | A | 10/1999 | Uglow | |
| 6,269,495 | B1 * | 8/2001 | Sondrup | 4/679 |
| 6,890,427 | B2 * | 5/2005 | Self et al. | 210/163 |
| 6,953,208 | B2 * | 10/2005 | Warnecke | 285/42 |
| 2003/0159384 | A1 * | 8/2003 | Warnecke | 52/302.1 |
| 2003/0159978 | A1 * | 8/2003 | Self et al. | 210/163 |
| 2005/0166315 | A1 * | 8/2005 | Warnecke et al. | 4/695 |
| 2005/0203468 | A1 * | 9/2005 | Warnecke | 604/317 |

* cited by examiner

*Primary Examiner* — Basil Katcheves
*Assistant Examiner* — Andrew J Triggs
(74) *Attorney, Agent, or Firm* — The Webb Law Firm

(57) ABSTRACT

A drain support plate for mounting and securing a drain assembly to a deck in a building structure.

22 Claims, 5 Drawing Sheets

DRAIN SUPPORT PLATE/UNDER-DECK CLAMP

CROSS-REFERENCE TO RELATED APPLICATION

This application is a continuation of U.S. patent application Ser. No. 11/122,448, filed May 5, 2005 now U.S. Pat. No. 7,784,242, which is a divisional application of U.S. patent application Ser. No. 10/342,148, filed Jan. 14, 2003, (now U.S. Pat. No. 6,953,208) which claims the benefit of U.S. Provisional Application No. 60/348,734, filed Jan. 15, 2002, which are incorporated herein by reference in their entirety.

BACKGROUND OF THE INVENTION

1. Field of the Invention

The present invention relates generally to a drain support plate and, more particularly, to a combined drain support plate and under-deck clamp.

2. Description of the Prior Art

Drains form an integral part of a building structure. For rainwater management, drains are used to keep water from accumulating on the building structure such as a roof. Oftentimes, successful drain installations are directly attributable to various factors, such as the receptacle body of a drain and the various structural conditions (i.e., deck type, thickness, accessibility, and location). A typical prior art drain 10 (shown in FIG. 1) generally includes a circular-shaped receptacle body 12 having a first end 14 and a second end 16, a spacer section 18 attached to the first end 14 of the receptacle body 12, a clamping collar 20 attached to the spacer section 18, and a slotted cover 22 attached to the clamping collar 20 for allowing water to pass through the receptacle body 12. The first end 14 of the receptacle body 12 includes an annular flange 24 extending away from the receptacle body 12. A plurality of protrusions 26 are defined adjacent the first end 14 of the receptacle body 12 underneath the flange 24 and extend away from the receptacle body 12. Each protrusion 26 can define a void 28 adapted to receive a fastener. The second end 16 of the receptacle body 12 is adapted to fasten to a drain pipe (not shown).

FIG. 2 shows a prior art drain receiver plate 30 that includes a body 32 having a planer first section 34, a tapered second section 38, and a planer third section 40. Referring to FIGS. 2 and 3, the first section 34 of the body 32 defining a peripheral edge 36 is spaced apart from the third section 40 of the body 32. The third section 40 of the body 32 having an upper surface 41 defines an inner edge 42. The second section 38 of the body 32 is positioned between the first section 34 and the third section 40 of the body 32 and tapers in a direction away from the peripheral edge 36 of the first section 34 of the body 32 toward the inner edge 42 of the third section 40 of the body 32 (shown in FIG. 3). The inner edge 42 of the third section 40 of the body 32 defines a center passageway 44 spaced radially and axially apart from the peripheral edge 36 of the first section 34 of the body 32 and is adapted to receive the receptacle body 12. The third section 40 of the body 32 also defines a plurality of cutouts 46 adapted to receive the protrusions 26 in the receptacle body 12. A distance D between the first section 34 and the third section 40 of the body 32 is sufficient for the upper surface 41 of the third section 40 of the body 32 to abut against a lower surface of the flange 24 on the receptacle body 12 (shown in FIG. 3).

FIG. 3 shows the installation of a prior art drain assembly 50 attached to a building structure 52. The structure 52 includes a deck 54 overlaid with building materials 56 such as waterproofing membranes, insulation or concrete. The assembly 50 includes the prior art drain 10 received within the prior art receiver plate 30, and a clamp 58 adapted to secure the receptacle body 12 to the deck 54, thus preventing axial and radial movement of the drain 10. The clamp 58 (referred to in the industry as an under-deck clamp) is positioned on a bottom surface of the deck 54 abutting the receptacle body 12. A fastener 60 is placed through the clamp 58 and deck 54 and received within the void 28 of the protrusion 26 of the receptacle body 12. The void 28 can be internally threaded for receiving a threaded fastener. A nut and washer arrangement 62 can be placed on the fastener 60, thus securing the clamp 58 against the underside of the deck 54.

When installing the prior art drain assembly 50 shown in FIG. 3, an opening 64 is cut in the deck 54 and the prior art receiver plate 30 is placed on top of the opening 64 in the deck 54. Next, the receptacle body 12 of the drain 10 is received within the passageway 44 of the receiver plate 30, whereby the protrusions 26 in the receptacle body 12 are received within the cutouts 46 in the third section 40 of the receiver plate 30. The remaining components of the drain 10 (i.e., spacer section 18, clamping collar 20 and the slotted cover 22) can then be attached to the receptacle body 12. Next, the clamp 58 is used to securely fasten the receptacle body 12 of the drain 10 to the deck 54 from underneath the deck 54. In order for this fastening to occur, the fastener 60 is received within the void 28 (threaded hole) in the protrusion 26 of the receptacle body 12 via the fastener 60 through the clamp 58 and the deck 54 from a bottom of the structure 52. The materials 56 can then be placed on top of the deck 54.

In the prior art installation, the drain 10 is separate from the clamp 58, thus requiring an installer to have some degree of installation expertise in order to properly install the drain 10. Also, the prior art installation requires an installer to install the drain assembly 50 from both the top and bottom of the roof structure 52, thus increasing installation time. Also, in the prior art installation, the installer must enter an unfinished building which can pose a safety hazard.

An object of the present invention is to reduce drain installation time and expense by eliminating a bottom installation of a drain. Also, an object of the present invention is to permit a safer installation of a drain.

SUMMARY OF THE INVENTION

The present invention provides for a drain support plate adapted to fasten to a receptacle body of a drain. A first end of the receptacle body includes at least one protrusion extending away from the receptacle body. A second end of the receptacle body adapts to fasten to a drain pipe. The drain support plate includes a body having a first portion, an intermediate portion, and a second portion. The first portion of the body is spaced from the second portion of the body. The first portion of the body also defines a peripheral edge. The second portion of the body having an inner edge defines a center passageway spaced radially and axially apart from the peripheral edge of the first portion of the body and adapts to receive the receptacle body. The intermediate portion is positioned between the first portion and the second portion of the body and tapers in a direction away from the peripheral edge of the first portion of the body toward the inner edge of the second portion of the body. An upper surface of the first portion of the body is contained in a first plane and an upper surface of the second portion of the body is contained in a second plane axially spaced from the first plane. The intermediate portion of the body extends from the first plane to the second plane. The first portion of the body can include a plurality of elongated first portion slots defined adjacent the peripheral edge and adapted to receive fasteners for securing the support plate to a deck. The second portion of the body also defines at least one slot adapted to receive a member for attaching the receptacle body to the body of the support plate. A distance between the first portion and the second portion of the body is sufficient for the second portion of the body to support the receptacle body. Further, the slot in the second portion of the body is adapted to be aligned with the receptacle body for receiving a member for attaching the receptacle body to the body of the support plate.

The present invention also provides for a drain support plate assembly that includes a receptacle body of a drain attached to a drain support plate as previously discussed. The support plate can be attached to the receptacle body via a member for attaching the receptacle body to the body of the support plate through the slot in the second portion of the body and the receptacle body. The support plate assembly can also be attached to a deck, wherein the receptacle body extends through an opening in the deck.

The present invention provides for a method of installing a drain in a building structure. First, an opening is formed in a deck. Second, a receptacle body of a drain and a drain support plate as discussed above are provided. Third, the receptacle body of the drain is attached to the second portion of the body of the support plate via a member for attaching the receptacle body to the body of the support plate through the slot in the second portion of the body and the receptacle body. A distance between the first portion and the second portion of the body is sufficient for the second portion of the body to support the receptacle body. Further, the slot in the second portion of the body is adapted to be aligned with the receptacle body for receiving a member for attaching the receptacle body to the body, whereby the receptacle body extends through the center passageway of the body of the support plate. Fourth, the support plate with the attached receptacle body is installed on an upper surface of the deck, wherein the receptacle body extends through the opening in the deck. Further, the support plate can be attached to the deck via fasteners through the first portion slots of the body and the deck or by welding the first portion of the body to the deck.

BRIEF DESCRIPTION OF THE DRAWINGS

A complete understanding of the invention will be obtained from the following description when taken in connection with the accompanying drawing figures wherein like reference characters identify like parts throughout.

DETAILED DESCRIPTION OF THE PREFERRED INVENTION

Figure 1:
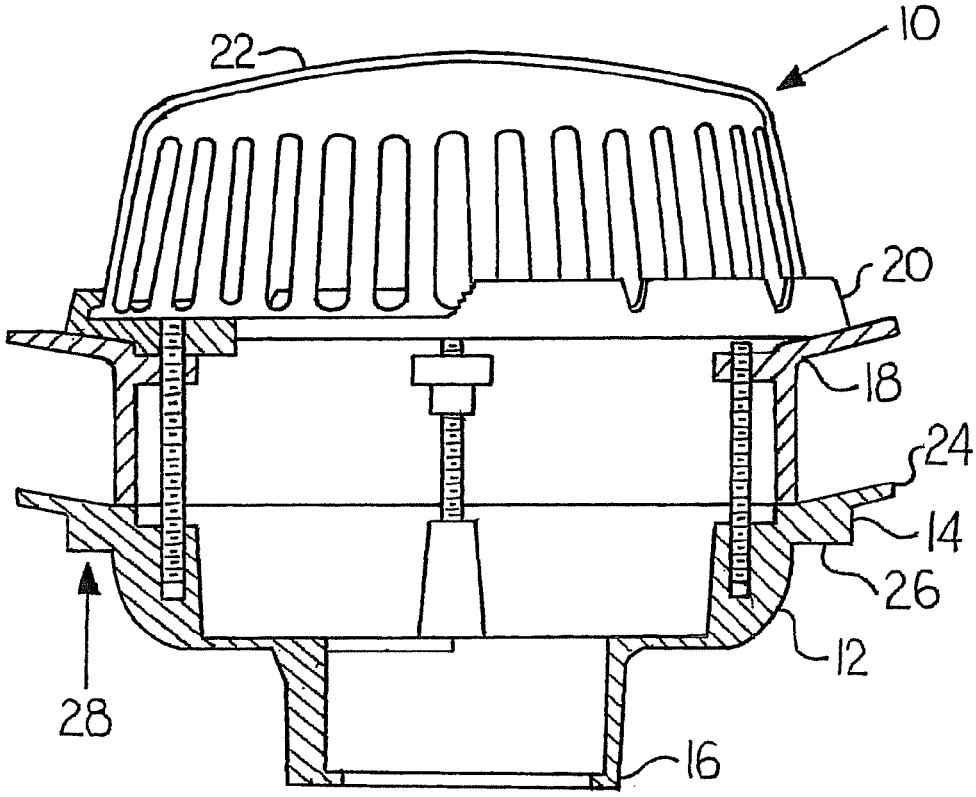
Fig. 1 (Prior Art)
FIG. 1 is a cross-sectional view of a typical prior art drain.
Figure 2:
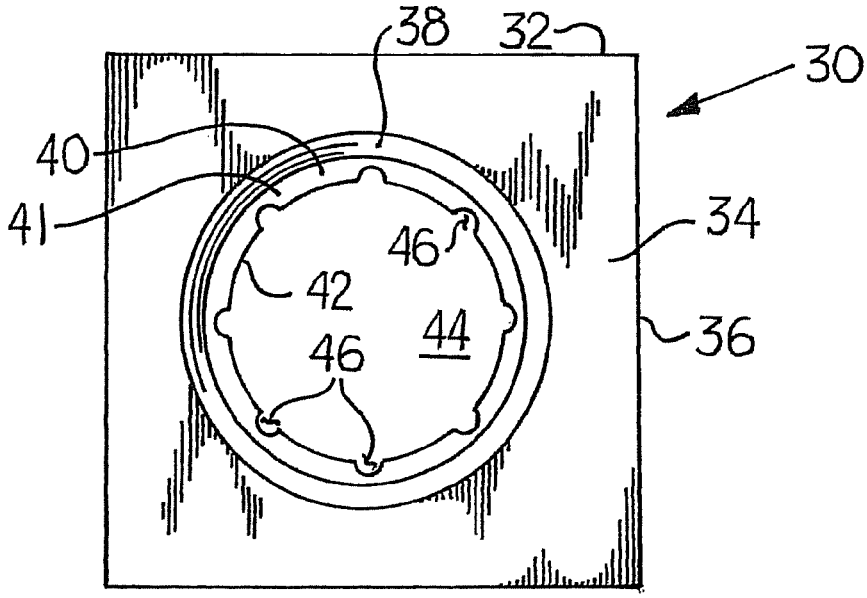
Fig. 2 (Prior Art)
FIG. 2 is a top plan view of a prior art drain receiver plate.
Figure 4:
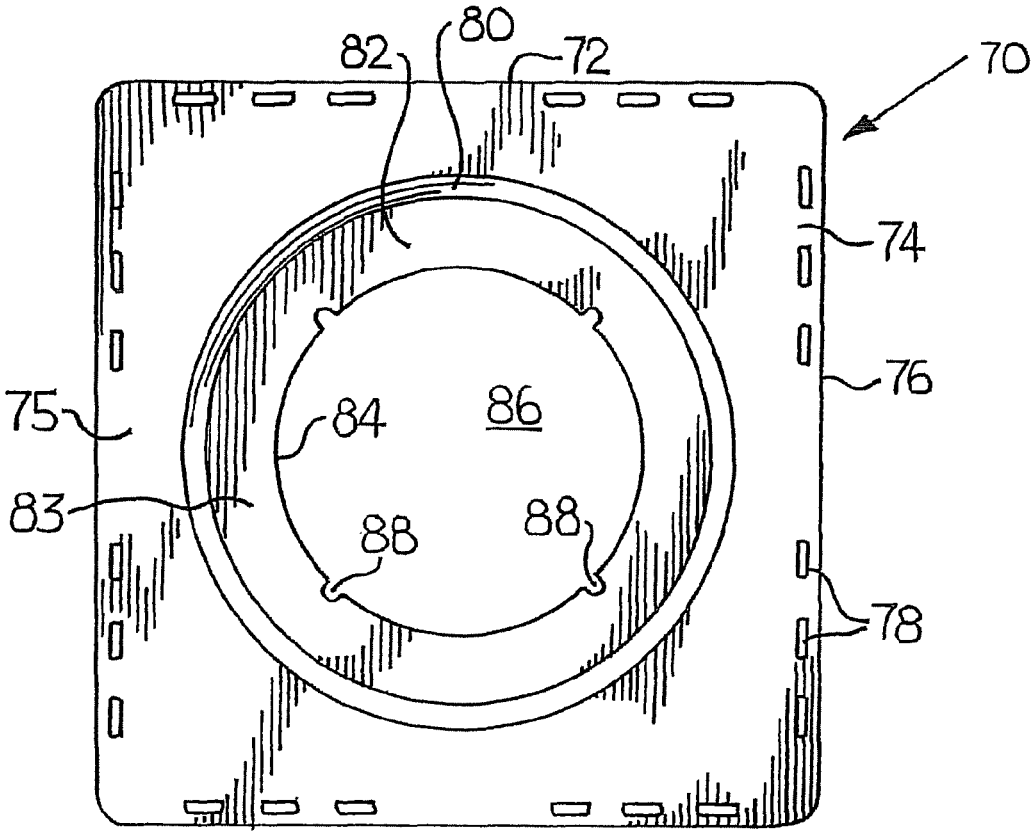
FIG. 4 is a top plan view of a drain support plate made in accordance with the present invention.
Figure 5:
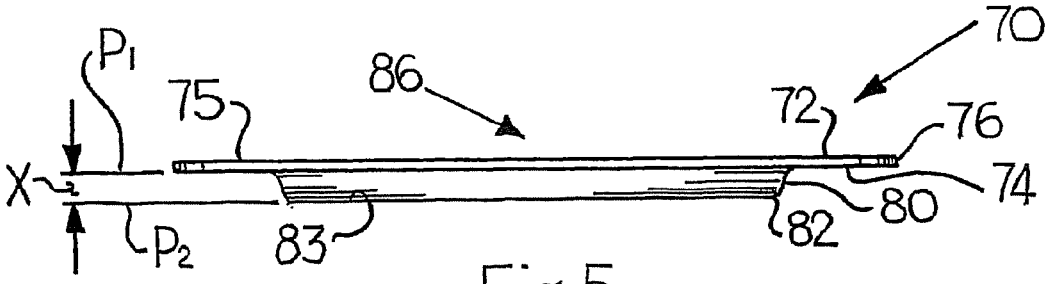
FIG. 5 is an elevational side view of the support plate shown in FIG. 4.
Figure 6:
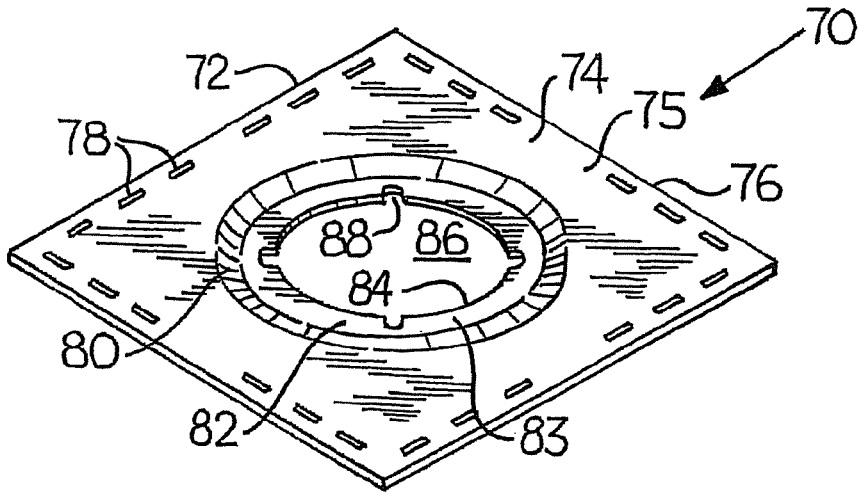
FIG. 6 is a top perspective view of the support plate shown in FIG. 4.

FIGS. 4, 5, and 6 show a drain support plate 70 made in accordance with the present invention that adapts to fasten to a receptacle body 12 of a prior art drain 10 (shown in FIG. 1). The support plate 70 includes a body 72 having a first portion 74, an intermediate portion 80, and a second portion 82. The body 72 can be made of a unitary piece of metal. The first portion 74 of the body 72 is rectangular shaped and defines a peripheral edge 76. The first portion 74 of the body 72 can also include a plurality of first portion slots 78 defined adjacent the peripheral edge 76 and adapted to receive a fastener 104 for securing the support plate 70 to a deck 54 (shown in FIG. 9). The first portion slots 78 can be elongated. The second portion 82 of the body 72 having an inner edge 84 defines a circular-shaped center passageway 86 that is spaced radially and axially apart from the peripheral edge 76 of the first portion 74 of the body 72. The first portion 74 is spaced from the second portion 82 of the body 72 and the intermediate portion 80 is positioned between the first portion 74 and the second portion 82 of the body 72. The intermediate portion 80 of the body 72 tapers in a direction away from the peripheral edge 76 of the first portion 74 of the body 72 toward the inner edge 84 of the second portion 82 of the body 72 (shown in FIG. 6). Referring to FIG. 5, an upper surface 75 of the first portion 74 of the body 72 is contained in a first plane $P_1$ and an upper surface 83 of the second portion 82 of the body 72 is contained in a second plane $P_2$ axially spaced from the first plane $P_1$. The intermediate portion 80 of the body 72 extends from the first plane $P_1$ to the second plane $P_2$. The first plane $P_1$ can also be parallel to the second plane $P_2$.

Figure 8:
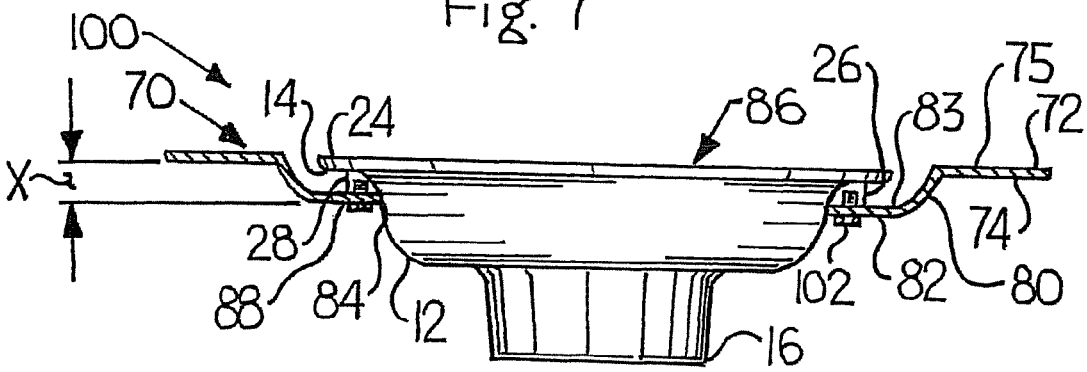
FIG. 8 is an elevational view of a drain support plate assembly made in accordance with the present invention.
Figure 9:
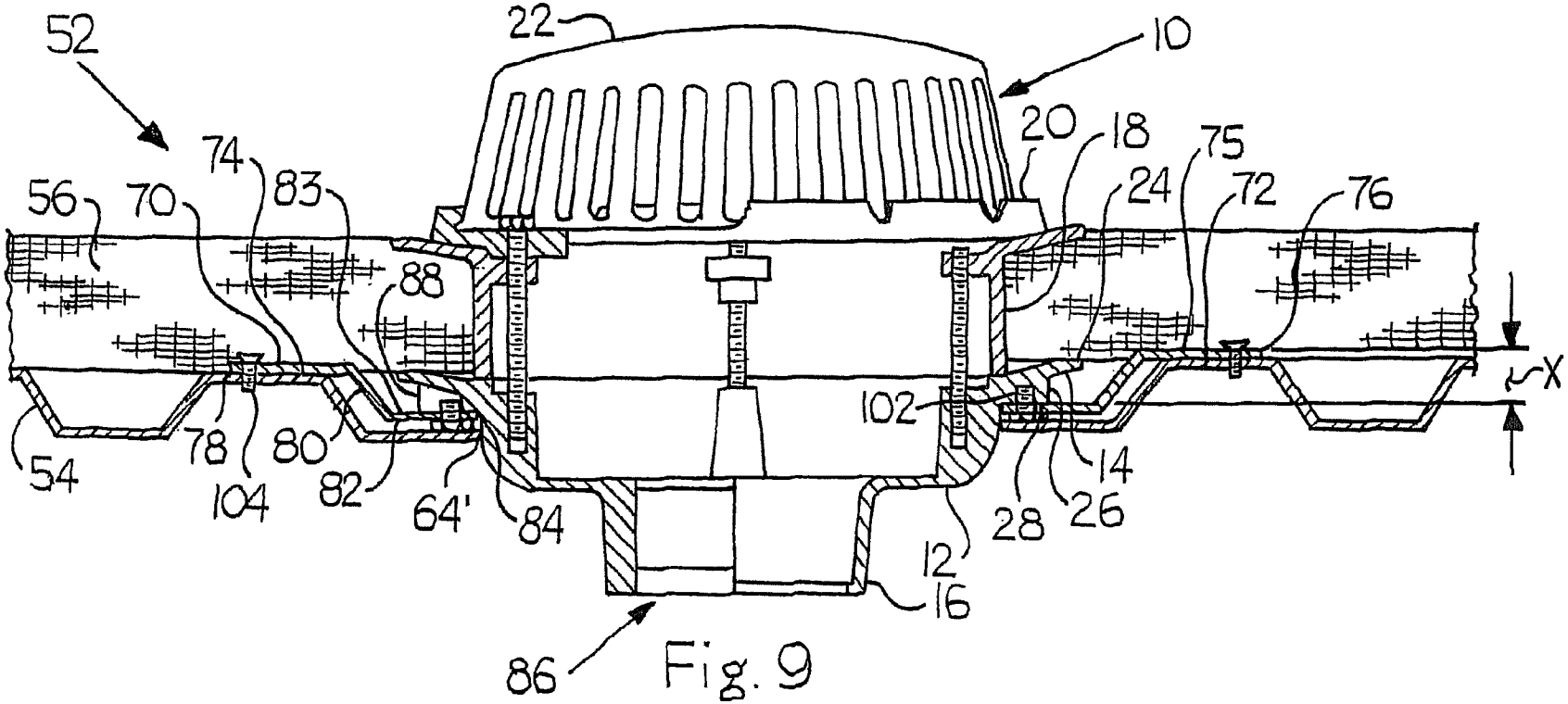
FIG. 9 is a partial cross-sectional view showing a drain installation made in accordance with the present invention utilizing the support plate shown in FIG. 4.

Referring to FIGS. 4 and 6, the inner edge 84 on the second portion 82 of the body 72 defines a plurality of slots 88 adapted to receive a member 102 for attaching the receptacle body 12 of the drain 10 to the body 72 of the support plate 70. The member 102 is a threaded fastener, such as a bolt or screw. The inner edge 84 of the second portion 82 of the body 72 is arcuate shaped and includes a plurality of arcs. Referring to FIGS. 5, 8, and 9, and with continuing reference to FIGS. 4 and 6, a distance X between the first portion 74 and the second portion 82 of the body 72 is sufficient for the second portion 82 of the body 72 to support the receptacle body 12 of the drain 10. The inner edge 84 is positioned below the protrusion 26 in the receptacle body 12. The slot 88 in the second portion 82 of the body 72 can be adapted to align with the receptacle body 12 for receiving the member 102. The slot 88 in the second portion 82 of the body 72 can also be adapted to align with the void 28 in the protrusion 26 of the receptacle body 12 for receiving the member 102, such as a fastener.

Figure 7:
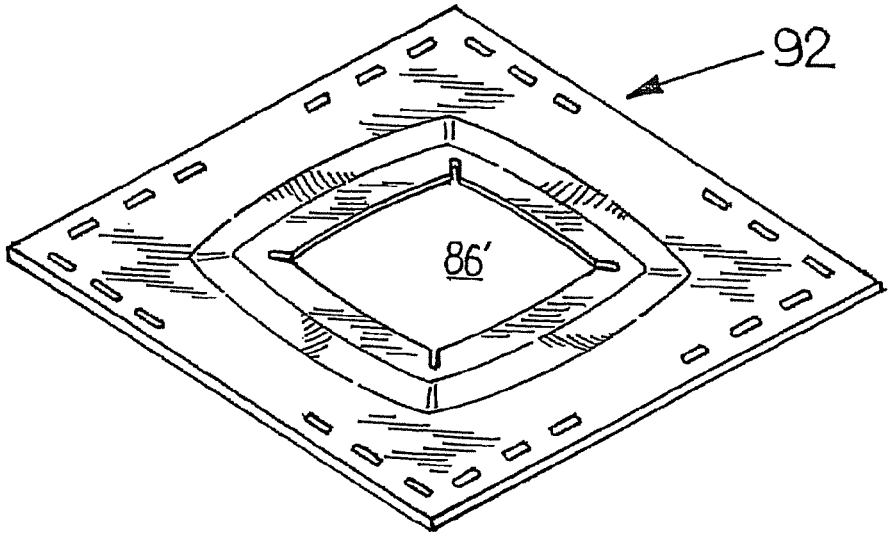
FIG. 7 is a top perspective view of a drain support plate made in accordance with a second embodiment of the present invention.

FIG. 7 shows a second embodiment of a drain support plate 92 similar to support plate 70 except that the center passageway 86' is geometric shaped in order to accommodate-various sizes and shapes of a drain.

Referring to FIG. 8, the present invention also provides for a drain support plate assembly 100 that includes the receptacle body 12 of the prior art drain 10 attached to the drain support plate 70. The assembly 100 can be attached via the member 102 for attaching the receptacle body 12 of the drain 10 to the body 72 of the support plate 70 through slot 88 in the second portion 82 of the body 72 and the receptacle body 12. Member 102 preferably is a threaded fastener that can be threadably received by internal threads in the void 28 of the protrusion 26 of the receptacle body 12. However, it is contemplated that member 102 can be formed in receptacle body 12 for engagement with slots 88 for attaching the receptacle body 12 to support plate 70. Referring to FIG. 9, the assembly 100 can be attached to the deck 54 via a fastener 104 through the deck 54 and the first portion slots 78 of the support plate 70, wherein the receptacle body 12 extends through an opening 64' in the deck 54. Heads or ends of members 102 may rest on an upper surface of the deck 54 sandwiched between the support plate 70 and the deck 54. The fastener 104 can be a sheet metal screw, pin, or rivet. The assembly 100 can also be attached to the deck 54 via welding the first portion 74 of the body 72 to the deck 54. The deck 54 can be made of corrugated metal.

Referring to FIG. 9, the present invention provides for a method of installing a drain 10 on a building structure 52. First, an opening 64' is formed in the deck 54. Second, a drain support plate assembly 100 as previously discussed is provided. The assembly 100 can be pre-assembled prior to installation on a deck or during installation. Third, the support plate assembly 100 is installed on an upper surface of the deck 54, whereby the receptacle body 12 extends through the opening 64' in the deck 54. Fourth, the first portion 74 of the body 72 of the support plate 70 is fastened to the deck 54 via fasteners 104 through the first portion slots 78 in the support plate 70. The support plate assembly 100 can also be attached to the deck 54 via welding the first portion 74 of the body 72 to the deck 54. Fifth, the remaining components of the drain 10 (i.e., spacer section 18, clamping collar 20, and slotted cover 22) can then be attached to the receptacle body 12. Finally, building materials 56 are then placed on top of the deck 54.

Figure 3:
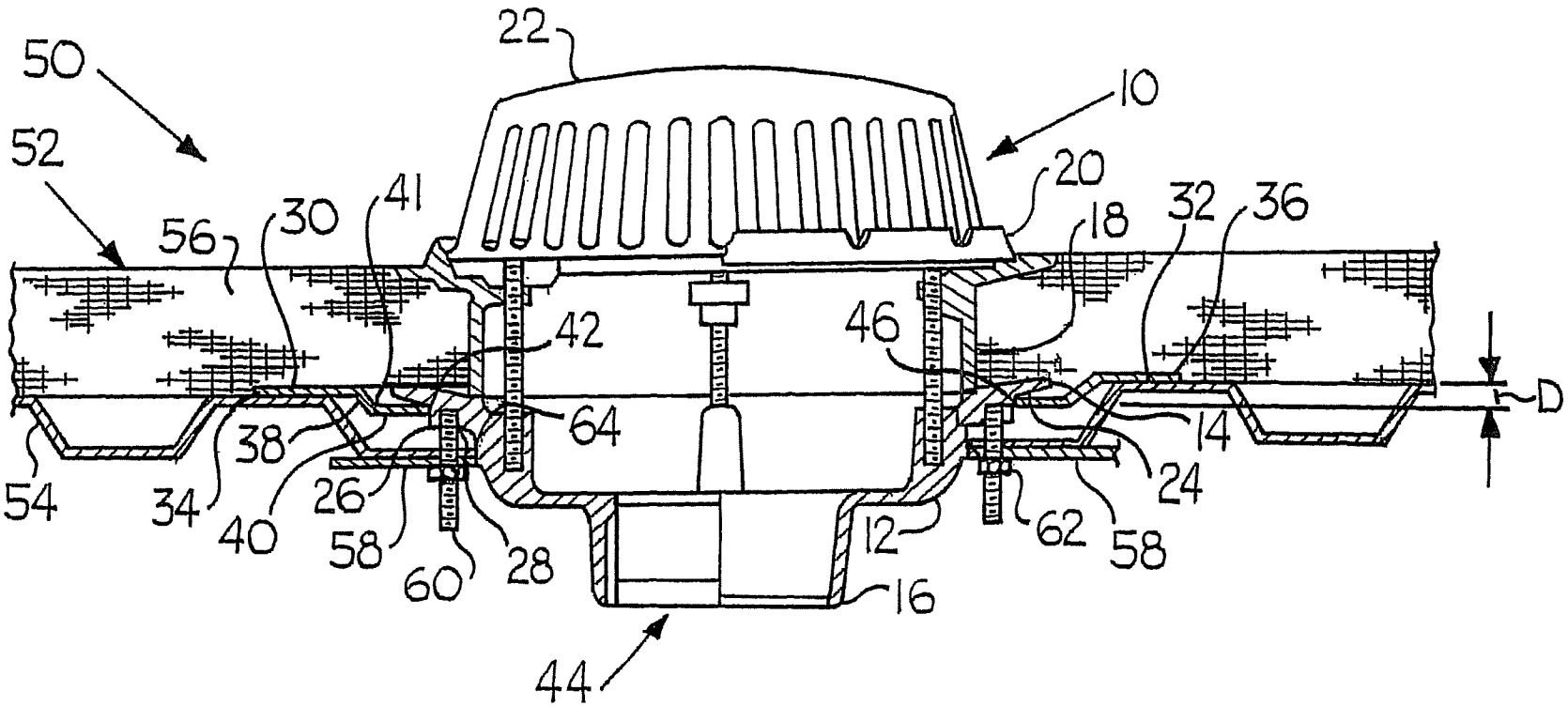
Fig. 3 (Prior Art)
FIG. 3 is a partial cross-sectional view showing a prior art drain installation utilizing the prior art receiver plate shown in FIG. 2.

An advantage to the design of the support plate 70 is that the attachment of the support plate 70 to the receptacle body 12 prior to installation (i.e., support plate assembly 100) eliminates a bottom installation, thus eliminating the need for the under-deck clamp 58 as described in the prior art installation of the drain 10 shown in FIG. 3. The present invention also reduces installation cost and time, and provides for a safer installation by only having a top installation.

It will be understood by those skilled in the art that while the foregoing description sets forth in detail preferred embodiments of the present invention, modifications, additions, and changes might be made thereto without departing from the spirit and scope of the invention.

I claim:

1. A drain support plate assembly comprising:

a receptacle body of a drain, said receptacle body having a first end and a second end, said first end of said receptacle body having an annular flange extending away from said receptacle body, said second end of said receptacle body adapted to fasten to a drain pipe; and a drain support plate having a body, said body having a first portion and a second portion, wherein said first portion of said body is spaced from said second portion of said body, said first portion of said body defining a peripheral edge, said second portion of said body having an inner edge defining a center passageway spaced radially and axially apart from said peripheral edge of said first portion of said body said center passageway configured for receiving said receptacle body extending therethrough, said first portion and said second portion defining a recess portion adapted to receive said annular flange of said receptacle body when said receptacle body extends through said center passageway of said body, wherein said support plate is attached to said receptacle body via at least one fastener extending through said support body and into at least a portion of said receptacle body when said annular flange is received within the recess portion of said body of said support plate to form the assembly wherein the assembly is adapted for subsequent attachment to a support surface.

2. The drain support plate assembly as claimed in claim 1, wherein the recess portion of said body of said support plate conforms to the shape of said annular flange of said receptacle body.

3. The drain support plate assembly as claimed in claim 1, wherein the support surface comprises a deck defining an opening for receiving a drain, said support plate assembly attached to said deck, wherein said receptacle body extends through said opening of said deck.

4. The drain support plate assembly as claimed in claim 3, wherein said deck is made of corrugated metal.

5. The drain support plate assembly as claimed in claim 3, wherein said body comprises a plurality of first portion slots defined adjacent said peripheral edge of said first portion of said body, and wherein said support plate is attached to said deck via fasteners through said first portion slots of said body and said deck.

6. The drain support plate assembly as claimed in claim 3 wherein said second portion of said body includes an inner edge, said inner edge defining at least one slot configured to receive the fastener for attaching the receptacle body of the drain to the body of the support plate.

7. The drain support plate assembly as claimed in claim 3 wherein said second portion of said body includes an inner edge, said inner edge being defined by an axially extending planar surface and wherein at least said second end of said receptacle body extends beyond said planar surface of said inner edge.

8. The drain support plate assembly as claimed in claim 7 wherein said receptacle body includes a basin and wherein at least a portion of said basin extends beyond said planar surface.

9. A drain support plate assembly comprising:

a receptacle body of a drain, said receptacle body having a first end and a second end, said first end of said receptacle body having an annular flange extending away from said receptacle body, said second end of said receptacle body adapted to fasten to a drain pipe; and a drain support plate having a body, said body having a first portion and a second portion, wherein said first portion of said body is spaced from said second portion of said body, said first portion of said body defining a peripheral edge, said second portion of said body having an inner edge defining a center passageway spaced radially and axially apart from said peripheral edge of said first portion of said body said center passageway configured for receiving said receptacle body extending therethrough, said first portion and said second portion defining a recess portion, wherein said support plate is attached to said receptacle body via a fastener for attaching said receptacle body to said body wherein said fastener extends through at least a portion of said recess portion of said body of said support plate and into at least a portion of said receptacle body to form the assembly wherein the assembly is adapted for subsequent attachment to a support surface.

10. The drain support plate assembly as claimed in claim 9, wherein the support surface comprises a deck defining an opening for receiving a drain, said support plate assembly attached to said deck, wherein said receptacle body extends through said opening of said deck.

11. The drain support plate assembly as claimed in claim 10, wherein said deck is made of corrugated metal.

12. The drain support plate assembly as claimed in claim 10, wherein said body comprises a plurality of first portion slots defined adjacent said peripheral edge of said first portion of said body, and wherein said support plate is attached to said deck via fasteners through said first portion slots of said body and said deck.

13. The drain support plate assembly as claimed in claim 10 wherein said second portion of said body includes an inner edge, said inner edge defining a one slot configured to receive the fastener for attaching the receptacle body of the drain to the body of the support plate.

14. The drain support plate assembly as claimed in claim 10 wherein said second portion of said body includes an inner edge, said inner edge defining at least one slot configured to receive the fastener for attaching the receptacle body of the drain to the body of the support plate.

15. The drain support plate assembly as claimed in claim 14 wherein said second portion of said body includes an inner edge, said inner edge being defined by an axially extending planar surface and wherein at least said second end of said receptacle body extends beyond said planar surface of said inner edge.

16. A drain support plate assembly comprising:

a receptacle body of a drain, said receptacle body having a first end and a second end, said first end of said receptacle body having an annular flange extending away from said receptacle body and at least one protrusion extending away from said receptacle body, said second end of said receptacle body adapted to fasten to a drain pipe; and a drain support plate having a body, said body having a first portion and a second portion, wherein said first portion of said body is spaced from said second portion of said body, said first portion of said body defining a peripheral edge, said second portion of said body having an inner edge defining a center passageway spaced radially and axially apart from said peripheral edge of said first portion of said body said center passageway configured for receiving said receptacle body extending therethrough, said first portion and said second portion defining a recess portion adapted to receive said annular flange of said receptacle body when said receptacle body extends through said center passageway of said body, wherein said support plate is attached to said receptacle body via at least one member for attaching said receptacle body to said body of said support plate when said annular flange is received within the recess portion of said body of said support plate to form the assembly, wherein said at least one protrusion defines a void and said at least one member is received with said void, and wherein the assembly is adapted for subsequent attachment to a support surface.

17. The drain support plate assembly as claimed in claim 16, wherein the recess portion of said body of said support plate conforms to the shape of said annular flange of said receptacle body.

18. The drain support plate assembly as claimed in claim 16, wherein the support surface comprises a deck defining an opening for receiving a drain, said support plate assembly attached to said deck, wherein said receptacle body extends through said opening of said deck.

19. The drain support plate assembly as claimed in claim 18, wherein said deck is made of corrugated metal.

20. The drain support plate assembly as claimed in claim 18, wherein said body comprises a plurality of first portion slots defined adjacent said peripheral edge of said first portion of said body, and wherein said support plate is attached to said deck via fasteners through said first portion slots of said body and said deck.

21. The drain support plate assembly as claimed in claim 18, wherein said second portion of said body includes an inner edge, said inner edge being defined by an axially extending planar surface and wherein at least said second end of said receptacle body extends beyond said planar surface of said inner edge.

22. The drain support plate assembly as claimed in claim 21, wherein said receptacle body includes a basin and wherein at least a portion of said basin extends beyond said planar surface.

* * * * *